US007104343B2

(12) United States Patent
Roberts

(10) Patent No.: US 7,104,343 B2
(45) Date of Patent: Sep. 12, 2006

(54) SOIL DRILL ROD EXTRACTOR

(75) Inventor: Jeffrey John Roberts, 1222 29th St., West Des Moines, IA (US) 50266

(73) Assignee: Jeffrey John Roberts, West Des Moines, IA (US)

( * ) Notice: Subject to any disclaimer, the term of this patent is extended or adjusted under 35 U.S.C. 154(b) by 151 days.

(21) Appl. No.: 10/264,700

(22) Filed: Oct. 4, 2002

(65) Prior Publication Data

US 2004/0065476 A1 Apr. 8, 2004

(51) Int. Cl.
*E21B 49/00* (2006.01)

(52) U.S. Cl. ..... 175/40; 254/20

(58) Field of Classification Search ..... 175/20, 175/40; 74/841; 173/36; 403/43–45, 118; 254/20, 231, 102; 411/37, 172, 111; 172/25
See application file for complete search history.

(56) References Cited

U.S. PATENT DOCUMENTS

| | | | | |
|---|---|---|---|---|
| 268,328 | A * | 11/1882 | Webber | 254/99 |
| 538,571 | A * | 4/1895 | Wilson | 254/99 |
| 2,416,501 | A | 2/1947 | Sundbergh | |
| 3,036,638 | A | 5/1962 | Parsons | |
| 3,324,958 | A | 6/1967 | Clark | |
| 3,515,230 | A | 6/1970 | Tomaine | |
| 3,696,873 | A | 10/1972 | Anderson | |
| 4,098,360 | A | 7/1978 | Clements | |
| 4,790,392 | A | 12/1988 | Clements | |
| 5,186,263 | A | 2/1993 | Kejr | |
| 5,663,649 | A | 9/1997 | Topp | |
| 5,777,242 | A | 7/1998 | Zuidberg | |
| 5,931,236 | A | 8/1999 | Mahlum | |
| 6,431,006 | B1 | 8/2002 | Henke | |

* cited by examiner

*Primary Examiner*—Frank S. Tsay
*Assistant Examiner*—K. Thompson
(74) *Attorney, Agent, or Firm*—Brian J. Laurenzo; Jason M. Hunt; Michael C. Gilchrist

(57) ABSTRACT

A rod extractor for ground drill rods having a drill rod (20) with a plurality of rod threads (23) at its upper portion, about which an extraction collar (30) with internal threads rotates slidably with said rod threads. A guide sleeve (51) having a sleeve opening is attached perpendicular to a ground plate (50) which rests on a ground surface. Said rod travels through said sleeve opening into the ground, upon which an extraction tool (40) rotates said collar about said rod resulting in downward travel of said collar in relation to said rod and sleeve until said collar contacts said sleeve. Further rotation of said collar results in upward force upon said rod, extracting it from the ground.

9 Claims, 6 Drawing Sheets

SOIL DRILL ROD EXTRACTOR

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

Field of Invention

This invention relates to the removal of a rod after it has been pressed or impacted into the earth, specifically to such rods used to create an underground hole for the subsequent insertion of a soil nuclear density gauge probe.

BACKGROUND OF THE INVENTION

When soil is placed during the construction process at a location where a future structure shall reside, it is common engineering practice to test the soil for compaction and moisture content. The compaction (relative density) and moisture content is verified to ensure adequate and sustainable bearing capacity for whatever structure will be built on it.

Many test methods have been created and utilized to determine compaction and moisture at a construction site, but one of the most accurate, quickest and common methods has become the use of a field nuclear density gauge. The nuclear gauge method starts by pounding a rod (typically around ¾ inches in diameter) into the ground approximately twelve inches. After the rod has been pounded into the ground, the operator has a tool that clamps onto the top of the rod. With manual twisting and pulling motions, the operator retracts the rod from the ground. The remaining hole is used as an encasement for the nuclear gauges source probe, which is inserted into the hole to run the test.

Current rod extractors typically consist of a simple two-handed tool that latches onto the top of the rod, allowing the rod to be manually twisted and pulled up at the same time. This process is relatively non-strenuous when sands or granular soils are encountered, but more clayey soils, especially lean or fat clays, exert much more sidewall force and friction upon the rod, making it very strenuous and sometime dangerous to manually retract the rod from the ground. Many times the force and effort required to withdraw the rod is so high that a weaker operator will be unable to remove the pin.

When pounded fully into the ground, the top of current rods, where the tool latches on, is approximately 5 inches above the surface of the ground. Many safety regulations require that heavy lifting be done with the knees, not the back. But with current rod extraction methods, the use of the knees would not provide near the upward or torsion force required to remove the pin. The only way to provide adequate force to remove current rods is with the use of the back and arms, which unfortunately has resulted in many back injuries.

One current method offered by a few manufacturers to alleviate the effort required to remove the rod is a lengthened rod rising to about chest height. The rod is encased with a heavy collar that travels up and down the rod. A circular stationary disc is secured on top of the rod. The operator slides the hammer quickly up the rod's shaft, impacting the hammer into the upper disc. The upward impacting forces pound the rod out of the ground. This method is used for nuclear gauge tests as well as other soil tests that require the insertion of a rod or probe into the ground. This method is relatively effective for the extraction phase, but the weight of the equipment is substantially more and more effort is required to carry the heavier equipment from test location to test location. No other system is currently in use that provides mechanical advantage during rod extraction from the ground. Typically operators are required to carry the equipment by hand; therefore any rod extraction system must be relatively lightweight and compact. Because of the hammering action upon the rod, typically with a 5-pound hammer, as well as other factors inherent to construction sites, the extraction systems must also be very durable.

U.S. Pat. No. 5,931,236 to CEE, L.L.C. and U.S. Pat. No. 5,186,263 to Kejr are soil-sampling systems with a soil probe that incorporate a screw mechanism providing movement for soil penetration or separation. These inventions provide for advantages in soil sampling and provide no mechanical advantage to remove a pin, under sidewall and friction resistance, from the ground. U.S. Pat. No. 4,790,392 to Clements provides mechanical advantage in retracting a soil probe with the use of a jacking mechanism, but this type of system would be bulky and heavy, and as with the previously mentioned upward hammer system, would require additional provisions and effort if it were to be transported and carried by an operator to numerous nuclear density tests. The incorporation of moving parts would also affect its durability.

BACKGROUND OF INVENTION

Objects and Advantages

Accordingly, several objects and advantages of the present invention are:

(a) to provide a simple design with no mechanically moving or delicate elements, allowing for increased durability and reliability;

(b) to provide quick and simple operation to execute the extraction of the rod;

(c) to provide a compact set of equipment, allowing for storage in existing nuclear gauge transporting containers;

(d) to provide a lightweight set of equipment, allowing for minimal effort in carrying the equipment from test to test;

(e) to provide a mechanical advantage that allows the extraction of rods under heavy sidewall and frictional forces;

(f) to provide a mechanical advantage that requires minimal effort and strength on the part of the operator; and (g) to provide elements that are resistant to dust, wet soils, and granular material commonly encountered during soils testing.

Further objects and advantages are the incorporation of elements similar to common equipment currently in use as described before, allowing for manual extraction of the rod without mechanical advantage. This is useful and efficient when sands or granular materials are encountered which require minimal effort to extract the rod. Still further objects and advantages will become apparent from a consideration of the ensuing description and drawings.

SUMMARY

In accordance with the present invention a ground soil penetrating drill rod that is threaded at its upper portion and encased by a threaded extraction collar at the upper portion of the drill rod, a vertical guide sleeve incorporated into a horizontal ground plate that is stabilized on a ground surface. After the drill rod travels through the guide sleeve and is pounded down into the ground, an extraction tool locks onto and provides rotation of the extraction collar, causing travel of the extraction collar down the drill rod until contact with the underlying guide sleeve, which provides stationary resistance. Further rotation of the extraction collar about the drill rod plus any needed upward force provides upward travel of the drill rod out of the ground.

DRAWINGS—FIGURES

DRAWINGS—REFERENCE NUMERALS

| | |
|---|---|
| 20 | drill rod |
| 21 | rod head |
| 22 | head notch |
| 23 | rod threads |
| 24 | rod stem |
| 25 | drill point |
| 30 | extraction collar |
| 31 | collar threads |
| 32 | collar notch |
| 33 | collar opening |
| 40 | extraction tool |
| 41 | tool claw |
| 42 | tool handle |
| 50 | ground plate |
| 51 | guide sleeve |
| 52 | sleeve opening |
| 62 | removable head |
| 64 | removable threads |
| 66 | removable sleeve |
| 72 | combined collar |
| 74 | enclosed claw |
| 76 | hex collar |
| 78 | tool stop |

DETAILED DESCRIPTION—FIGS. 1A, 2–5A—PREFERRED EMBODIMENT

Figure 1A:
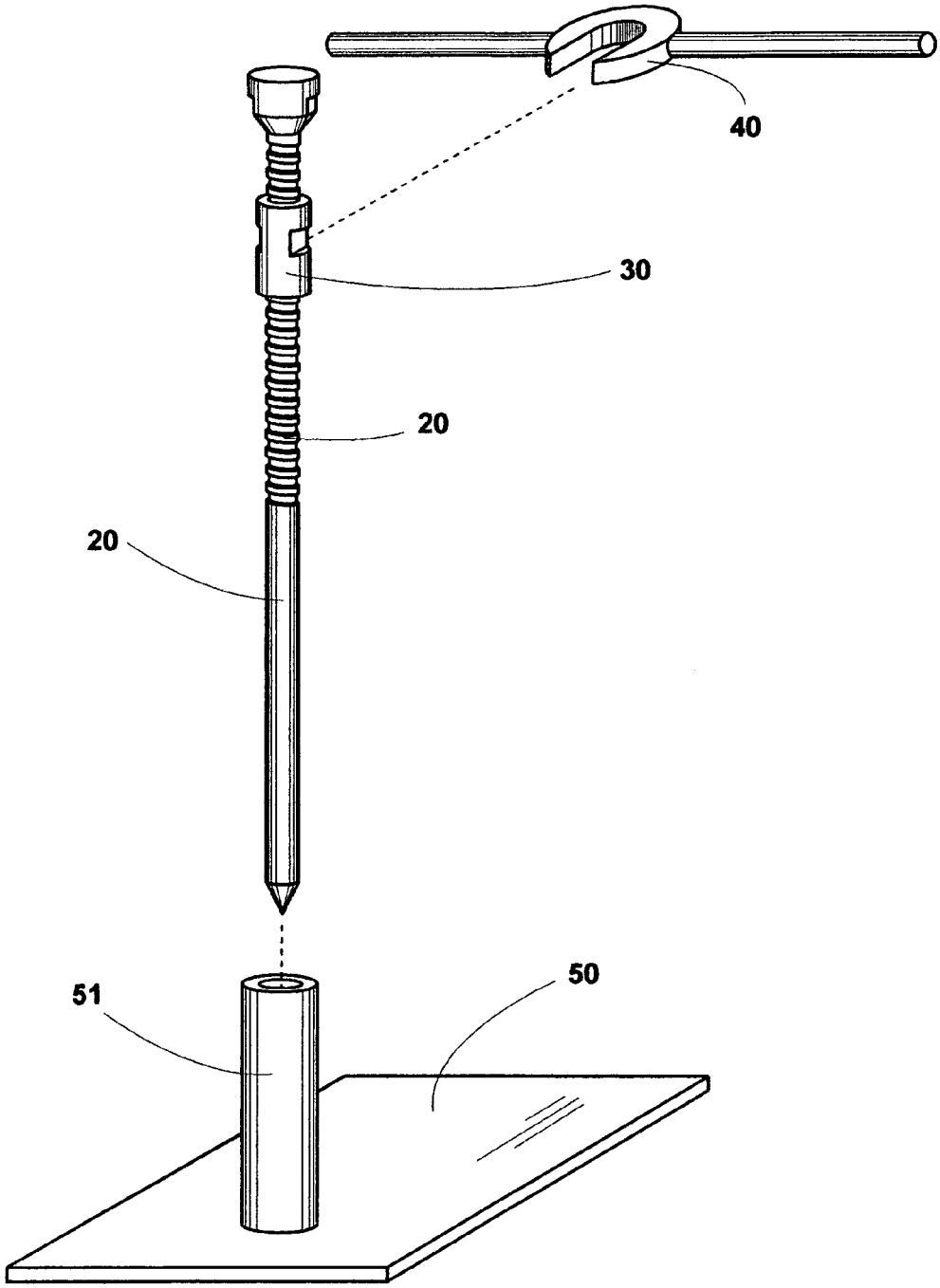
FIG. 1A is an isometric view of a soil drill rod extractor.

A preferred embodiment of the soil drill rod extractor is illustrated in FIG. 1A. The drill rod 20 has an extraction collar 30 at the upper portion of the drill rod 20. The extraction collar 30 rotates about the drill rod 20 and thus travels up and down. The extraction tool 40 slides into the extraction collar 30.

Figure 2:
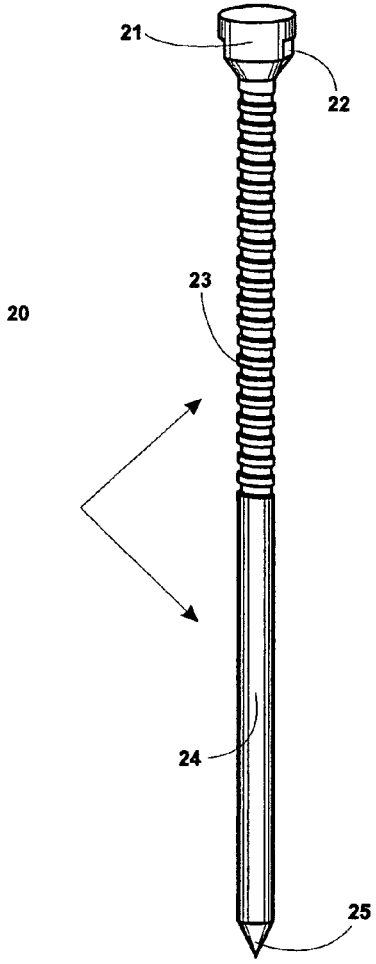
FIG. 2 is a detailed isometric view of a drill rod.

The drill rod 20 is shown in detail in FIG. 2. The drill rod 20 has a rod head 21 that absorbs the impacts that drive the dill rod 20 downward. The rod head 21 has a head notch 22 that accepts the extraction tool 40. The upper portion of the drill rod 20 has rod threads 23 that provide travel in relation to the extraction collar 30. The bottom portion of the drill rod 20 has a rod stem 24 that travels into the ground. At the end of the rod stem 24 is a drill point 25 that provides the leading edge during travel into the soil. The rod threads 23 typically have a relatively low amount of threads per inch of rod length (4–6) and a relatively loose fit, allowing for durability in high grit environments.

Figure 3:
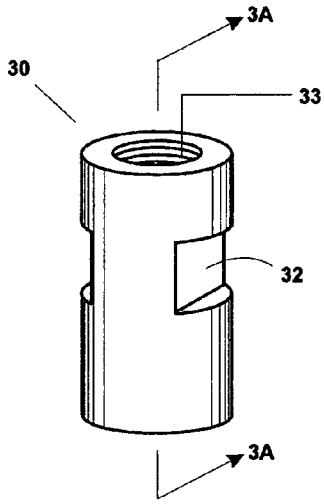
FIG. 3 is a detailed isometric view of an extraction collar.
Figure 3A:
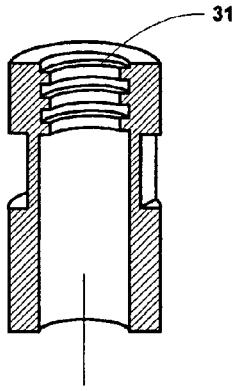
FIG. 3A is a cross-section view of the extraction collar.

The extraction collar 30 is shown in detail in FIG. 3A. Inside of the extraction collar 30 is the collar opening 33 for the drill rod 20. At a portion or throughout the entire height of the collar opening 33 are collar threads 31, as shown in the section view in FIG. 3A. The collar threads 31 provide travel in relation to the drill rod 20. On the outside of the extraction collar 30 is a collar notch 32 that accepts the extraction tool 40.

Figure 4:
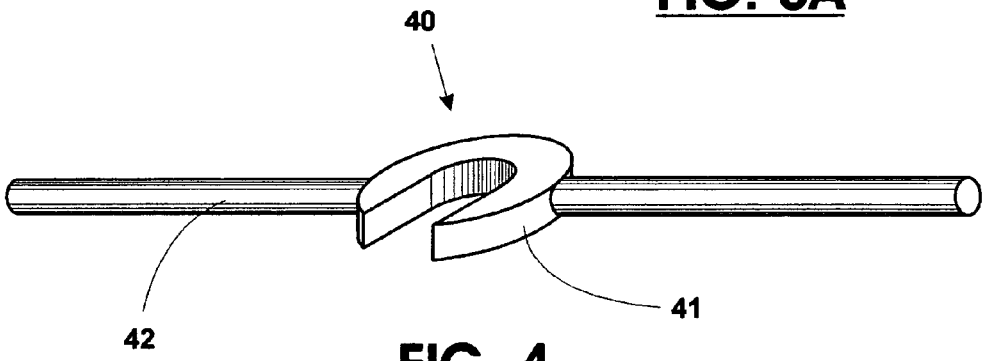
FIG. 4 is a detailed isometric view of an extraction tool.

The extraction tool 40 is shown in detail in FIG. 4. The extraction tool typically has (two) tool handles 42. Providing attachment to the extraction collar 30 is a tool claw 41 which provides contact for both rotational and upward force upon the extraction collar 30. The tool handles 42 are rigidly secured to the tool claw 41 to provide the appropriate durability to withstand bending or separation. The tool claw 41 mates with the collar notch 32 with as low a tolerance and as tight of a fit as feasible.

Figure 5:
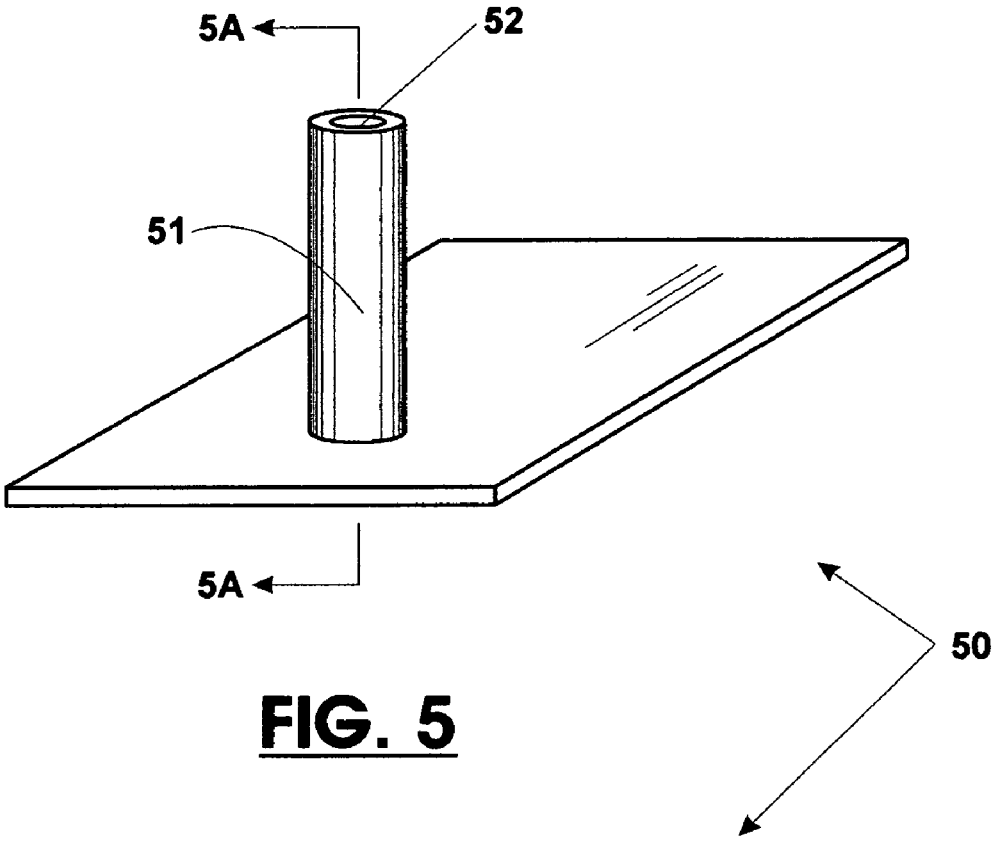
FIG. 5 is a detailed isometric view of a ground plate.
Figure 5A:
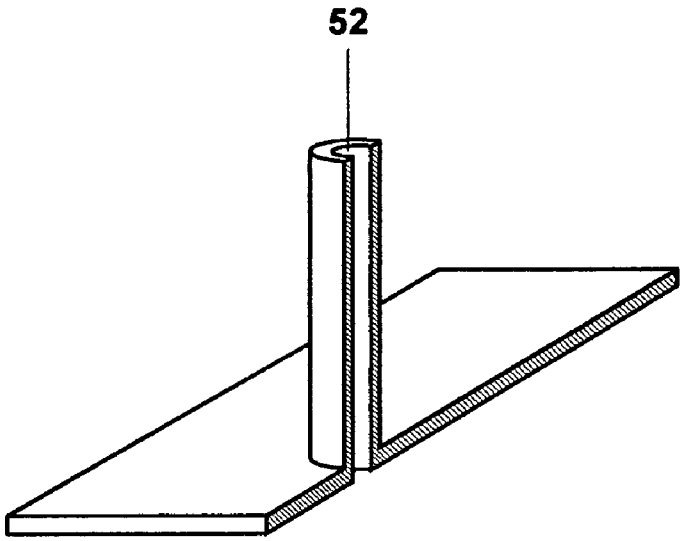
FIG. 5A is a cross-section view of the ground plate.

The ground plate 50 is shown in detail in FIG. 5A. The ground plate 50 has a guide sleeve 51. Inside the guide sleeve 51 is a sleeve opening 52 as shown in the section view of FIG. 5A. The guide sleeve 51 is perpendicular to the ground plate. The guide sleeve 51 is rigidly secured to the ground plate 50 to provide the appropriate durability to withstand heavy abuse.

All items are typically constructed of the appropriate hardness of steel to withstand the forces and impacts they will encounter. The ground plate 50 may be constructed of a lighter weight material, such as aluminum, to allow for less strain upon the operator when carrying the equipment from test to test. If the ground plate is constructed of aluminum or other material that is susceptible to gouging, the top portion of the guide sleeve 51 shall remain a hardened steel to withstand the rotating contact with the extraction collar 30.

Figure 6:
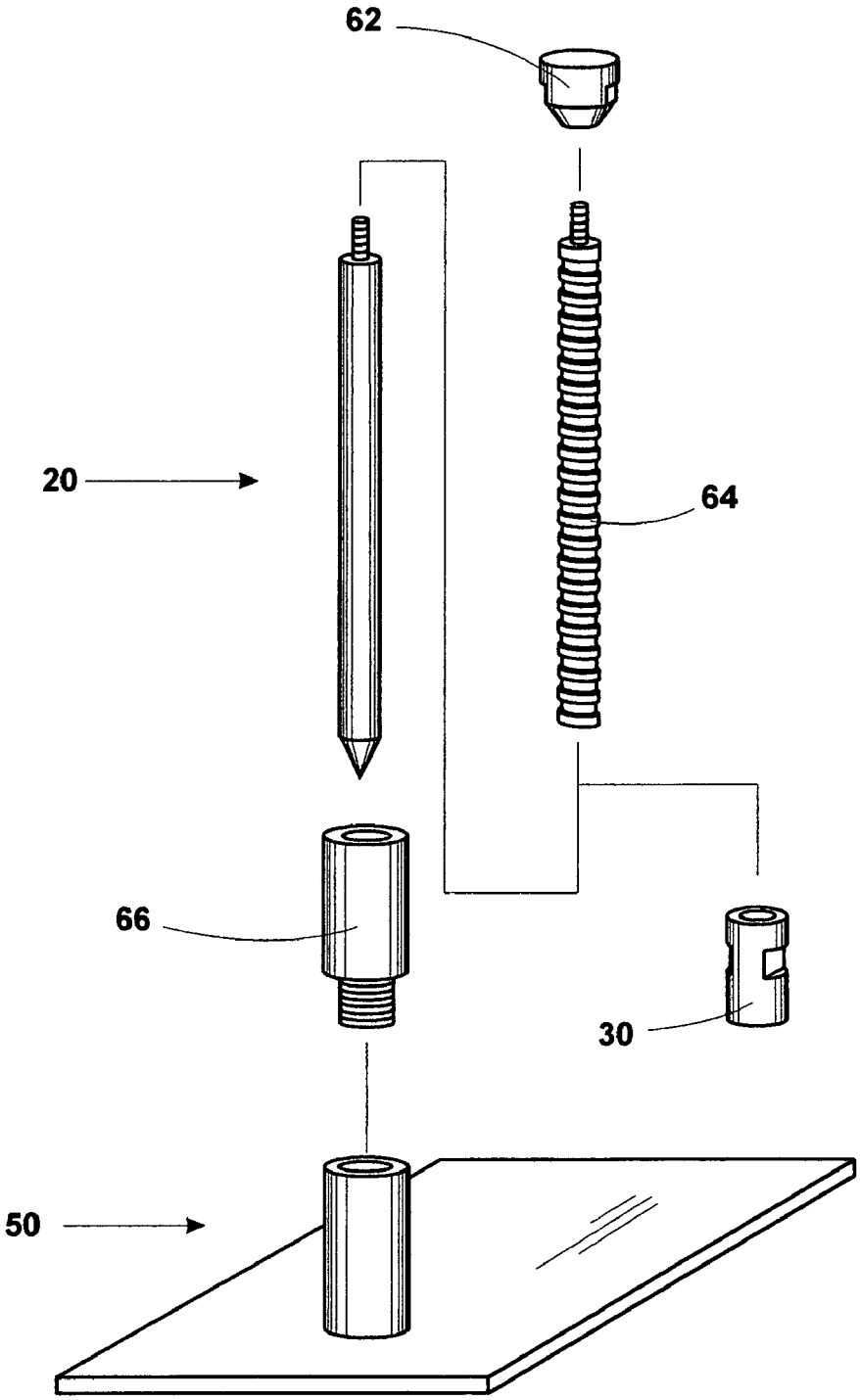
FIG. 6 shows removable assemblies to a drill rod and ground plate.

FIG. 6—Additional Embodiments

Additional embodiments are shown in FIG. 6. These primarily allow for the disassembly of either the drill rod 20 or the ground plate 50. The disassembly of the drill rod 20 with the use of a removable head 62 and/or removable threads 64 would be beneficial if the extraction collar 30 or any portion of the drill rod 20 would require replacement and would also allow more compact transportation if needed. The disassembly of the ground plate 50 with the use of a removable sleeve 66 would be beneficial if the top of the guide sleeve 51 and its body were of differing materials or if more compact transportation if needed.

Figure 7:
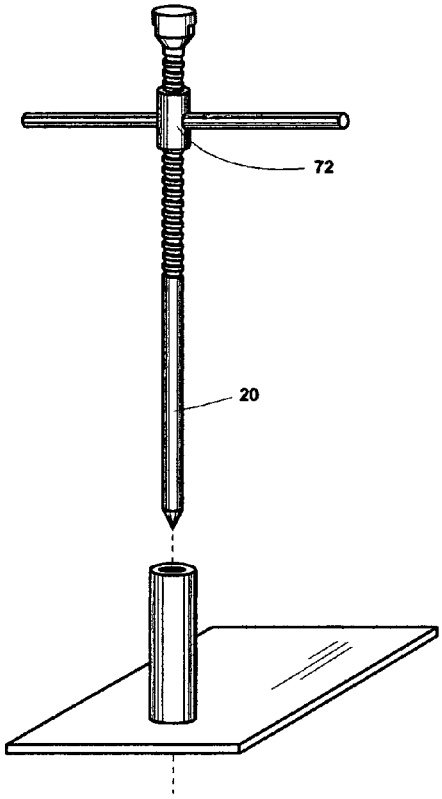
FIG. 7 shows an extractor with a combined extraction tool.
Figure 7A:
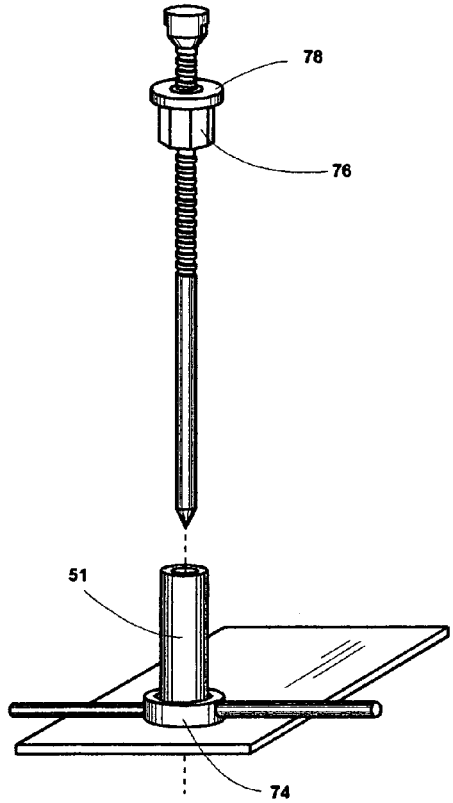
FIG. 7A shows an extraction collar and an extractor with an enclosed tool claw.

FIG. 7A—Alternative Embodiments

There are various possibilities with regard to the rotation of the threaded collars (not shown) that provide the upward travel of the drill rod 20. FIG. 6 shows a combined collar 72 which does not require a tool (not shown) to be inserted during operation. FIG. 6 also shows an enclosed claw 74 which is placed around the guide sleeve 51 before the drill rod 20 is inserted into the guide sleeve 51. There is also numerous ways that a tool (not shown) may lock into a collar (not shown), such as a hex collar 76. There are also numerous ways for a collar (not shown) to provide for the upward force of a tool (not shown) upon the drill rod 20, such as a tool stop 78.

Figure 1B:
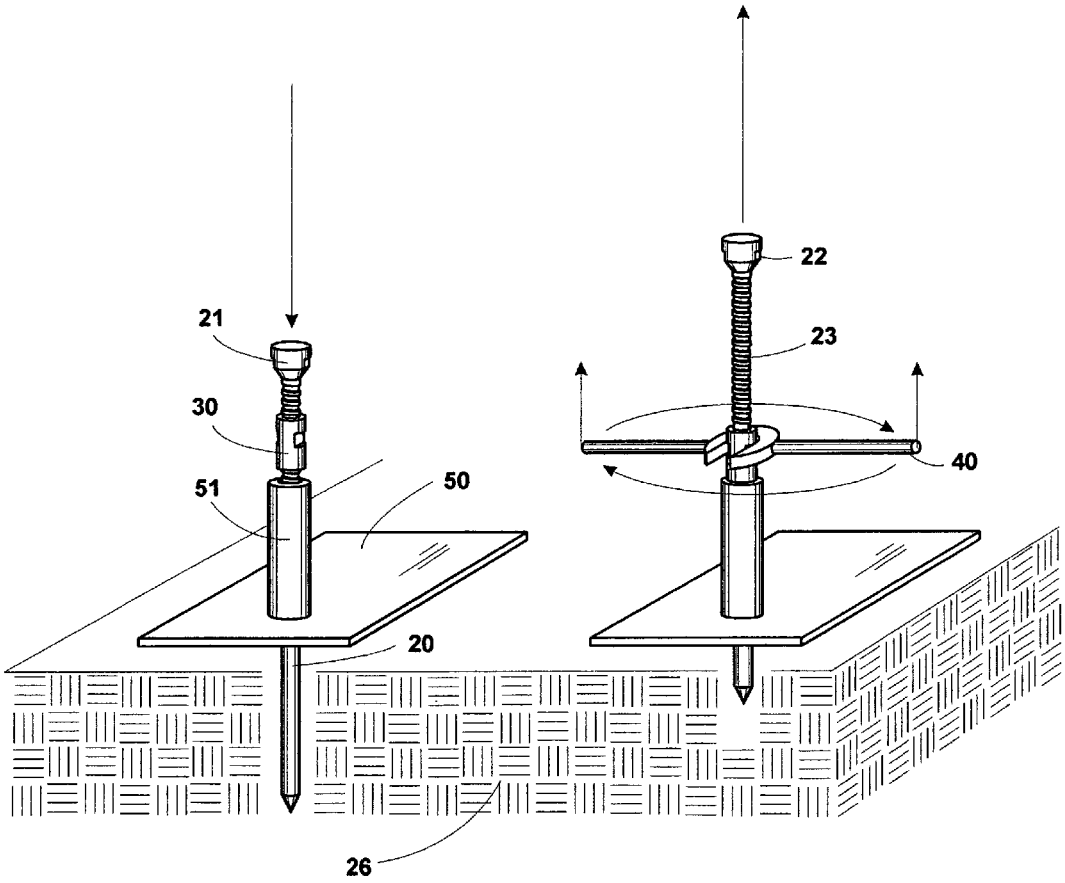
FIG. 1B is an isometric view showing the operation of a soil drill rod extractor.

Operation—FIG. 1B

The manner of impacting the drill rod 20 into the ground is identical to that for rods in present use. The ground plate 50 is placed on a ground 26 surface. The drill rod 20 is inserted down into the guide sleeve 51 until it contacts the ground 26, upon which it is impacted, typically with a heavy hammer. The guide sleeve 51 guides the drill rod 20 into the ground 26 perpendicular to the ground 26 surface until it reaches the desired depth. The maximum depth is when the top of the extraction collar 30 is rotated up to contact the rod head 21 and the drill rod 20 travels downward until the bottom of the extraction collar 30 contacts the guide sleeve 51.

Upon reaching the desired or maximum depth into the ground 26, the extraction tool 40 is guided onto the extraction collar 30. The extraction tool 40 is then rotated by the operator, causing downward travel of the extraction collar 30 in relation to the drill rod 20. When the extraction collar 30 contacts the stationary guide sleeve 51, further rotation of the extraction collar 30 causes upward force upon the drill rod 20, extracting it from the ground. The extraction tool 40 locks into the extraction collar 30 in such a manner that provides not only rotation of the extraction collar 30 but also the ability to lift upward upon the extraction collar when the ground sidewall and frictional forces upon the drill rod 20 have been appropriately minimized.

The rod head 21 also has a head notch 22 which accepts the extraction tool 40. This allows the faster direct manual rotation and lifting of the drill rod 20 when sand or other granular ground materials are encountered. To retract the extraction collar 30 up the rod threads 23 for preparation of the next usage, the extraction tool remains attached to the extraction collar 30 and the operator may spin the extraction tool 40 freely until it travels to the rod head 21.

Advantages

From the description above, a number of advantages of my soil drill rod extractor become evident:

(a) The tool shall fit securely onto the collar, allowing the tool to remain in place during the extraction of the rod as well as the retraction of the collar for the next use.
(b) The tool is accessible and easy to grip and rotate.
(c) The soil drill rod extractor, with its simple design, may be relatively easy to produce.
(d) The type of rotation of the collar and the ensuing upward travel in relation to the rod shall provide a substantial upward force upon the rod.

Conclusion, Ramifications, and Scope

Accordingly, the reader will see that the soil drill rod extractor may be used not only for a mechanical advantage in retracting a rod that is firmly planted in the ground, but also may be used to manually twist and pull the rod from the ground similar to methods currently in use. As stated, this may be beneficial and faster under certain conditions when the rod is subjected to little or no resistance. Furthermore, the soil rod drill extractor has the additional advantages in that

- it provides a way to extract rods that would be impossible to extract with only the manual strength of an operator;
- it provides a mechanical advantage in extracting hard-to-pull rods that have been pounded into the ground and requires very little effort or strain on the part of the operator, providing a more enjoyable and safer work environment;
- its use is simple and easy to understand;
- the complete operation of extracting the rod to retraction of the collar for the next use is relatively short in time;
- its relatively lightweight and weighs no more than current manual extractors in use, allowing it to be easily carried by an operator from test to test;
- there are no mechanical or intricate moving parts that erode over time or require regular maintenance;
- its relatively simple design, while providing the intended functionality, also provides the durability required for the abusive environment that it will encounter;
- its compact and fully compatible with most nuclear gauge transporting cases currently in use.

Although the description above contains much specificity, these should not be construed as limiting the scope of the invention but merely providing illustrations of some of the presently preferred embodiments of this invention. For example, the threads may come in many sizes and styles. Furthermore, there are many ways in which the tool attaches to the collar, rotates the collar, or remains attached to the collar while being rotated or lifted up against the collar.

Thus the scope of the invention should be determined by the appended claims and their legal equivalents, rather than by the example given.

The invention claimed is:

1. A soil drill rod extractor for insertion and removal of a soil drill rod from the ground, comprising:

(a) said drill rod having a plurality of alternating rod threads,
(b) an extraction collar surrounding said drill rod having a smooth and un-threaded exterior surface and internal threads rotatably engaging said rod threads,
(c) a guide sleeve perpendicularly connected to a flat ground plate for stabilization with the ground surface and a sleeve opening through which said drill rod travels down into the ground precisely perpendicular to the ground surface, whereby impact of said drill rod forces said drill rod into the ground perpendicular to the ground surface, whereby rotation of said extraction collar causes travel of said extraction collar down the said drill rod into contact with said guide sleeve, whereby further rotation of said extraction collar results in upward force upon said drill rod, whereby said drill rod travels up out of the ground.

2. The soil drill rod extractor of claim 1, wherein said rod threads are located at the upper portion of said drill rod, wherein the lower portion of said drill rod is smooth and un-threaded, whereby insertion into and extraction from the ground of said drill rod results in a hole in the ground of specified and uniform diameter.

3. The soil drill rod extractor of claim 1, wherein said guide sleeve is cylindrical in shape, said guide sleeve comprising a centered hole traveling from top to bottom, said centered hole cylindrical in shape, said guide sleeve attached rigidly and directly to said ground plate, wherein said ground plate is of uniform thickness.

4. The soil drill rod extractor of claim 1, further comprising a means for rotating said extraction collar, comprising a tool handle having a length capable of raising said drill rod from the ground, wherein rotational or upward force is applied directly from said extraction collar to said drill rod.

5. The soil drill rod extractor of claim 1, wherein said drill rod comprises a rod head to receive impacts driving said drill rod into the ground.

6. The soil drill rod extractor of claim 5, wherein said rod head comprises a means for rotating and lifting said drill rod.

7. The soil drill rod extractor of claim 5, comprising a means for rotating and lifting said drill rod, comprising an extraction tool that slides onto said rod head, so that rotational or upward force is applied to said drill rod.

8. The soil drill rod extractor of claim 1, wherein lower, un-threaded portion of said drill rod having an annular cross section.

9. The soil drill rod extractor of claim 1, wherein said drill rod comprises a drill point at the bottom.

* * * * *